US012286317B2

(12) United States Patent
Nozaki

(10) Patent No.: US 12,286,317 B2
(45) Date of Patent: Apr. 29, 2025

(54) SHEET FEEDER, AUTOMATIC SHEET FEEDER, IMAGE READER, AND IMAGE FORMING APPARATUS

(71) Applicant: Wataru Nozaki, Kanagawa (JP)

(72) Inventor: Wataru Nozaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 213 days.

(21) Appl. No.: 18/144,828

(22) Filed: May 8, 2023

(65) Prior Publication Data

US 2023/0391568 A1 Dec. 7, 2023

(30) Foreign Application Priority Data

Jun. 7, 2022 (JP) ..... 2022-092178
Mar. 14, 2023 (JP) ..... 2023-039974

(51) Int. Cl.
*B65H 1/14* (2006.01)
*B65H 1/04* (2006.01)
(Continued)

(52) U.S. Cl.
CPC ..... *B65H 1/14* (2013.01); *B65H 1/04* (2013.01); *B65H 3/0661* (2013.01); *B65H 7/02* (2013.01); *B65H 7/10* (2013.01); *B65H 7/18* (2013.01); *B65H 9/101* (2013.01); *B65H 9/166* (2013.01); *B65H 2301/13* (2013.01); *B65H 2301/331* (2013.01); *B65H 2511/12* (2013.01); *B65H 2513/50* (2013.01); *B65H 2513/51* (2013.01);
(Continued)

(58) Field of Classification Search
CPC ... B65H 1/04; B65H 1/08; B65H 1/14; B65H 7/00; B65H 7/02; B65H 7/10; B65H 7/14; B65H 7/18; B65H 9/101; B65H 2301/13; B65H 2301/331; B65H 2405/11162; B65H 2405/11163; B65H 2405/1117; B65H 2511/12; B65H 2513/50; B65H 2513/51; B65H 2513/52; B65H 2513/512; B65H 2801/06
See application file for complete search history.

(56) References Cited

U.S. PATENT DOCUMENTS

2020/0307930 A1* 10/2020 Okamoto ..... H04N 1/0057
2021/0163244 A1* 6/2021 Nakamura ..... B65H 1/04
(Continued)

FOREIGN PATENT DOCUMENTS

JP 2004-238160 8/2004
JP 2009-029546 2/2009

*Primary Examiner* — Prasad V Gokhale
(74) *Attorney, Agent, or Firm* — Duft & Bornsen, PC

(57) ABSTRACT

A sheet feeder includes a stacker, a sheet feeding member, an aligner, a switcher, a size specifying unit, and circuitry. The sheet feeding member contacts and feeds a sheet stack on the stacker. The aligner is movable to align a position in a sheet width direction of the sheet stack on the stacker. The switcher switches the aligner from a separation state to a contact state without waiting for a feeding start instruction after the sheet stack is stacked on the stacker. The circuitry delays a switching completion time when the size in the sheet width direction of the sheet stack specified by the size specifying unit is smaller than a given size, to be later than the switching completion time when the size in the sheet width direction of the sheet stack is equal to or greater than the given size.

20 Claims, 11 Drawing Sheets

(51) Int. Cl.

| | |
|---|---|
| ***B65H 3/06*** | (2006.01) |
| ***B65H 7/02*** | (2006.01) |
| ***B65H 7/10*** | (2006.01) |
| ***B65H 7/18*** | (2006.01) |
| ***B65H 9/10*** | (2006.01) |
| ***B65H 9/16*** | (2006.01) |

(52) U.S. Cl.
CPC .... *B65H 2513/512* (2013.01); *B65H 2801/06* (2013.01)

(56) References Cited

U.S. PATENT DOCUMENTS

| | | | | |
|---|---|---|---|---|
| 2021/0198069 | A1* | 7/2021 | Okamoto ..... | B65H 5/062 |
| 2021/0347589 | A1 | 11/2021 | Suzuki et al. | |
| 2021/0403273 | A1 | 12/2021 | Haraguchi et al. | |
| 2022/0169458 | A1 | 6/2022 | Suzuki et al. | |
| 2022/0289512 | A1 | 9/2022 | Takahashi et al. | |
| 2022/0334523 | A1 | 10/2022 | Akiyama et al. | |
| 2022/0380166 | A1 | 12/2022 | Nozaki et al. | |
| 2023/0001731 | A1 | 1/2023 | Haraguchi et al. | |

* cited by examiner

SHEET FEEDER, AUTOMATIC SHEET FEEDER, IMAGE READER, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2022-092178, filed on Jun. 7, 2022, and 2023-039974, filed on Mar. 14, 2023, in the Japan Patent Office, the entire disclosure of each of which is hereby incorporated by reference herein.

BACKGROUND

Technical Field

Embodiments of the present disclosure relate to a sheet feeder, an automatic sheet feeder, an image reader, and an image forming apparatus.

Background Art

Various types of sheet feeders provided with a sheet stacker on which a sheet bundle is placed, a sheet feeding member to contact an uppermost sheet of the sheet stack on the sheet stacker to feed the uppermost sheet, and an aligner that is movable in a sheet width direction of the sheet stack and aligns the position in the sheet width direction of the sheet stack on the sheet stacker.

For example, a typical sheet feeding device includes a document restricting plate (aligner) to align the position in the sheet width direction of a sheet stack of original documents (sheets) placed on a document tray serving as a stacker. In such a sheet feeding device, the document tray is movable in the vertical direction by a lifting unit (switching unit). Before the documents are placed on the document tray, the document tray is at a given lower position, in other words, in a separation state in which the uppermost face of the document stack and a pickup roller serving as a sheet feeing member separate from each other. With the document stack on the document tray, a detector detects the size of the document. When the detection result of the detector is a regular size, it is determined that the document stack is properly placed on the document tray. In this case, raising the document tray starts at the timing at which a predetermined time passes since the document stack is placed on the stacker, where the document tray is at a predetermined raised position (i.e., the contact state where the uppermost face of the document stack and the pickup roller contact with each other. Then, inputting a document reading start signal (i.e., a document feeding start instruction) starts conveyance of the document stack immediately. On the other hand, when the detection result of the detector is not a regular size, it is determined that the document stack is not properly placed on the document tray. In this case, raising the document tray would not start before the document reading start signal is input.

SUMMARY

Embodiments of the present disclosure described herein provide a novel sheet feeder including a stacker, a sheet feeding member, an aligner, a switcher, a size specifying unit, and circuitry. The stacker stacks a sheet stack. The sheet feeding member contacts the sheet stack stacked on the stacker to feed each sheet of the sheet stack. The aligner is movable in a sheet width direction of the sheet stack and aligns a position in the sheet width direction of the sheet stack on the stacker. The switcher switches the aligner from a separation state to a contact state without waiting for a feeding start instruction after the sheet stack is stacked on the stacker. The sheet stack on the stacker and the sheet feeding member separate from each other in the separation state. The sheet stack on the stacker and the sheet feeding member contact with each other in the contact state. The size specifying unit specifies a size in the sheet width direction of the sheet stack on the stacker. The circuitry delays a switching completion time from the separation state to the contact state when the size in the sheet width direction of the sheet stack specified by the size specifying unit is smaller than a given size, to be later than a switching completion time when the size in the sheet width direction of the sheet stack is equal to or greater than the given size.

Further, embodiments of the present disclosure described herein provide an automatic sheet feeder including the above-described sheet feeder.

Further, embodiments of the present disclosure described herein provide an image reader including the above-described sheet feeder.

Further, embodiments of the present disclosure described herein provide an image forming apparatus including the above-described sheet feeder.

Further, embodiments of the present disclosure described herein provide a sheet feeder including a stacker, a sheet feeding member, an aligner, a switcher, a size specifying unit, a position sensor, and circuitry. The stacker stacks a sheet stack. The sheet feeding member contacts the sheet stack on the stacker to feed each sheet of the sheet stack. The aligner is movable in a sheet width direction of the sheet stack and aligns a position in the sheet width direction of the sheet stack on the stacker. The switcher switches the aligner from a separation state to a contact state without waiting for a feeding start instruction after the sheet stack is stacked on the stacker. The sheet stack on the stacker and the sheet feeding member separate from each other in the separation state. The sheet stack on the stacker and the sheet feeding member contact with each other in the contact state. The size specifying unit specifies a size in the sheet width direction of the sheet stack on the stacker. The position sensor acquires the position of the aligner in the sheet width direction. The circuitry delays a switching completion time from the separation state to the contact state when an error between a position of the aligner in the sheet width direction of the sheet stack corresponding to the size in the sheet width direction of the sheet stack specified by the size specifying unit and a position of the aligner in the sheet width direction of the sheet stack acquired by the position sensor is greater than a given error, to be later than the switching completion time when the error is equal to or smaller than the given error.

Further, embodiments of the present disclosure described herein provide an automatic sheet feeder including the above-described sheet feeder.

Further, embodiments of the present disclosure described herein provide an image reader including the above-described sheet feeder.

Further, embodiments of the present disclosure described herein provide an image forming apparatus including the above-described sheet feeder.

BRIEF DESCRIPTION OF THE SEVERAL VIEWS OF THE DRAWINGS

Exemplary embodiments of this disclosure will be described in detail based on the following figures, wherein.

Figure 1:
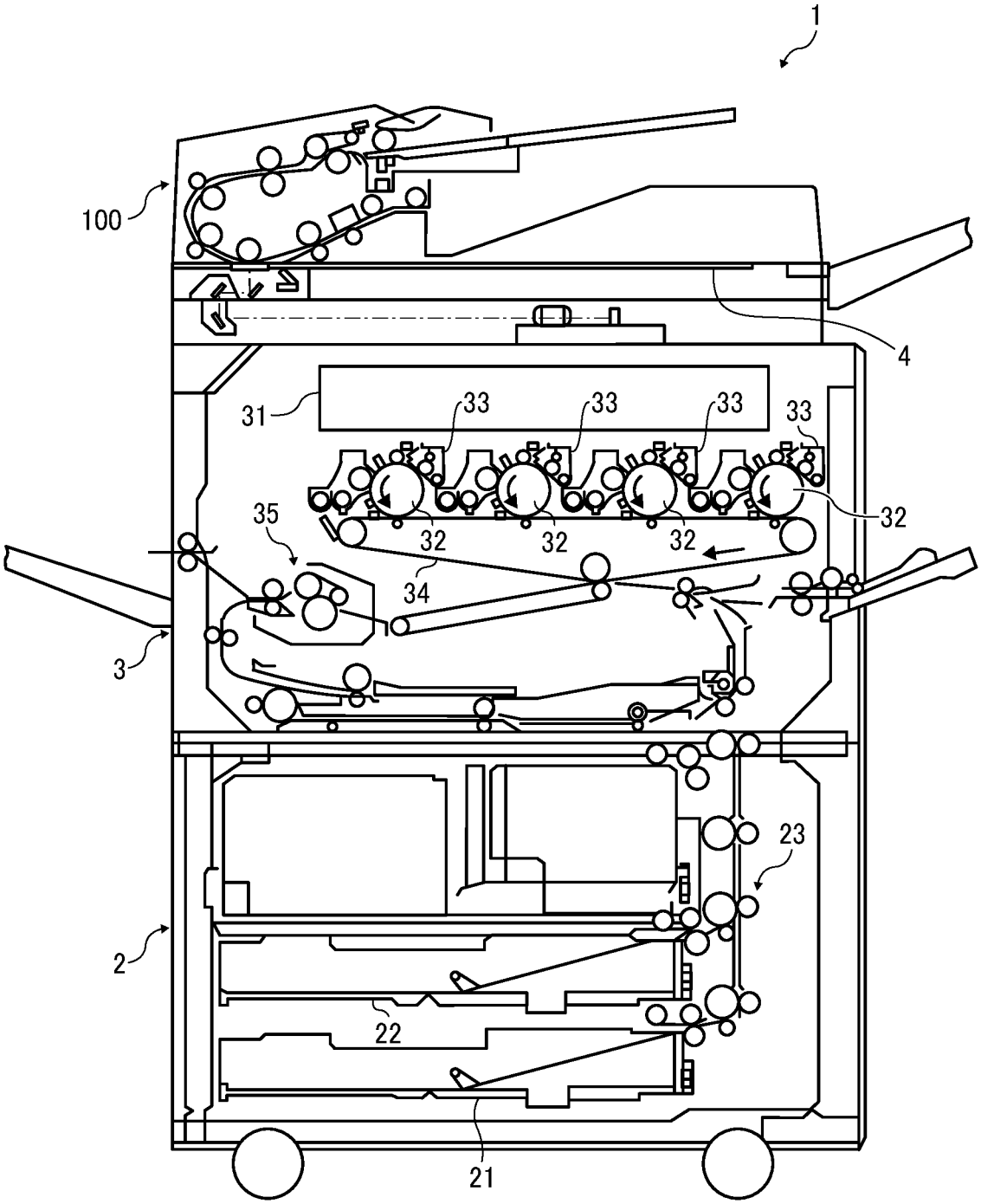
FIG. 1 is a diagram illustrating a schematic configuration of a copier serving as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of an example applicable to a sheet feeder, an automatic sheet feeder, an image reader, and an image forming apparatus, according to an embodiment of the present disclosure, with reference to the following figures.

Specifically, the descriptions given below relate to a sheet feeder according to an embodiment of the present disclosure that is applied to an automatic document feeder (ADF) serving as an automatic sheet feeder, an image reader, and an image forming apparatus.

FIG. 1 is a diagram illustrating a schematic configuration of a copier 1 serving as an image forming apparatus according to an embodiment of the present disclosure.

The copier 1 according to the present embodiment is provided with the automatic document feeder (ADF) 100, a sheet feeding device 2, and an image forming device 3.

The sheet feeding device 2 includes sheet trays 21 and 22 and sheet conveyors 23. Transfer sheets (sheets) as recording media having different sizes are accommodated in the sheet trays 21 and 22. The sheet conveyors 23 as various rollers by which the transfer sheets accommodated in the sheet trays 21 and 22 are conveyed to the image forming device 3.

The image forming device 3 includes an exposure device 31, photoconductor drums 32 for four colors, developing devices 33, a transfer belt 34, and a fixing device 35. In the image forming device 3, the exposure device 31 exposes the photoconductor drums 32 with light to form respective latent images on the photoconductor drums 32 based on image data of the original document read by the image reader disposed inside the ADF 100. Subsequently, the developing devices 33 for separate colors supply toners of the separate colors onto the photoconductor drums 32 to develop the latent images on the photoconductor drums 32 to visible toner images. Further, the image forming device 3 transfers respective toner images developed on the photoconductor drums 32 onto the transfer belt 34 to form a composite color image. The image forming device 3 further transfers the composite color image onto a recording sheet supplied from the sheet feeding device 2 and fuses the toner of the composite color image by the fixing device 35 to fix the composite color image to the recording sheet.

Figure 2:
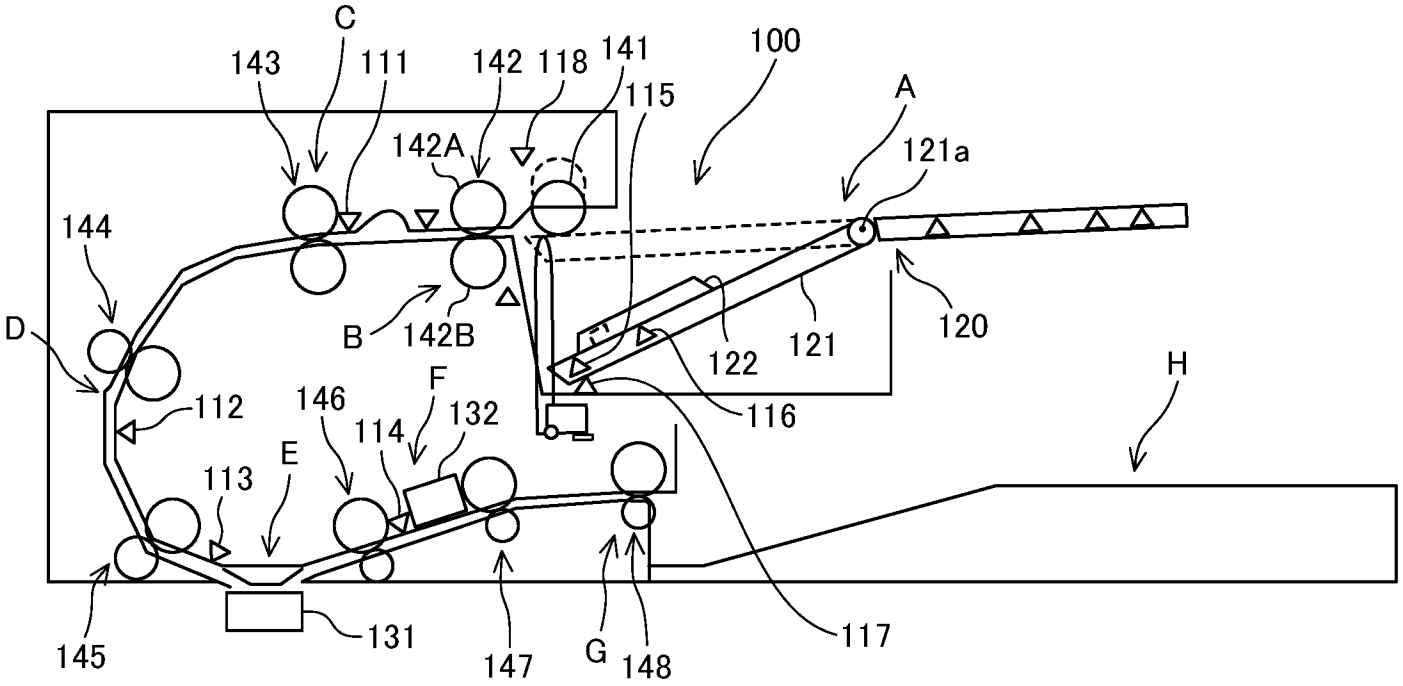
FIG. 2 is a diagram illustrating a schematic configuration of an automatic document feeder (ADF) attached to the copier of FIG. 1.

FIG. 2 is a diagram illustrating a schematic configuration of the ADF 100 serving as an image reader.

As illustrated in FIG. 1, the ADF 100 is attached to the upper part of the copier 1. The ADF 100 includes a document setting section A, a sheet separation section B, a registration section C, a sheet turning section D, a first reading section E, a second reading section F, a sheet ejection section G, and a sheet stacking section H. The document stack is set on the document setting section A. The sheet separation section B separates and feeds original documents one by one from the document stack set on the document setting section A. The registration section C allows the original document to contact a roller pair to be primarily aligned, and conveys the aligned original document by drawing from the roller pair. The original document to be conveyed is turned in the sheet turning section D so that the document face is disposed opposite to the document reading side (i.e., the lower part in the drawing) of a first image reader 131. The first reading section E is a section where the first image reader 131 reads an image on the front face of the original document from below an exposure glass 4. The second reading section F is a section where a second image reader 132 reads an image on the back face of the original document after the image on the front side of the original document has been read. The sheet ejection section G is a section from which the original document is ejected to the outside of the ADF 100 after completion of reading the images on the front and back faces of the original document. The sheet stacking section H stacks and holds the ejected original documents.

A single original document or a stack of two or more original documents to be read by the ADF 100 is set on the document setting section A. The stack of two or more original documents is collectively referred to as a "document stack". The document stack is set on a document table 120 serving as a stacker including a movable document table 121.

In this embodiment, the exposure glass 4 made of a light-transmissive member is disposed on the upper face of the housing of the copier 1 and the ADF 100 is disposed adjacent to the exposure glass 4. The ADF 100 is openable and closable so as to open and close the exposure glass 4 via a hinge mechanism.

The ADF 100 is compatible with both a sheet-through reading method (e.g., an automatic conveyance mode) and a fixed document reading method (e.g., a pressure plate mode). The sheet-through reading method is a method to read an image is read by one or both of the first image reader 131 and the second image reader 132 while an original document to be read is conveyed at a given speed when the first image reader 131 is fixed. The fixed document reading method is a method to read an image of an original document to be read when the original document is placed on the exposure glass 4 and the first image reader 131 moves along the exposure glass 4.

An operation mode can be set as desired to the copier 1 according to the present embodiment by operating the operation panel 5 (see FIG. 3) serving as an operation receiver that receives a user operation. The operation mode may be, for example, the automatic conveyance mode (i.e., the ADF mode) in which an original document is read by the above-described fixed document reading method or the pressure plate mode in which an original document is read by the above-described sheet-through reading method.

Figure 3:
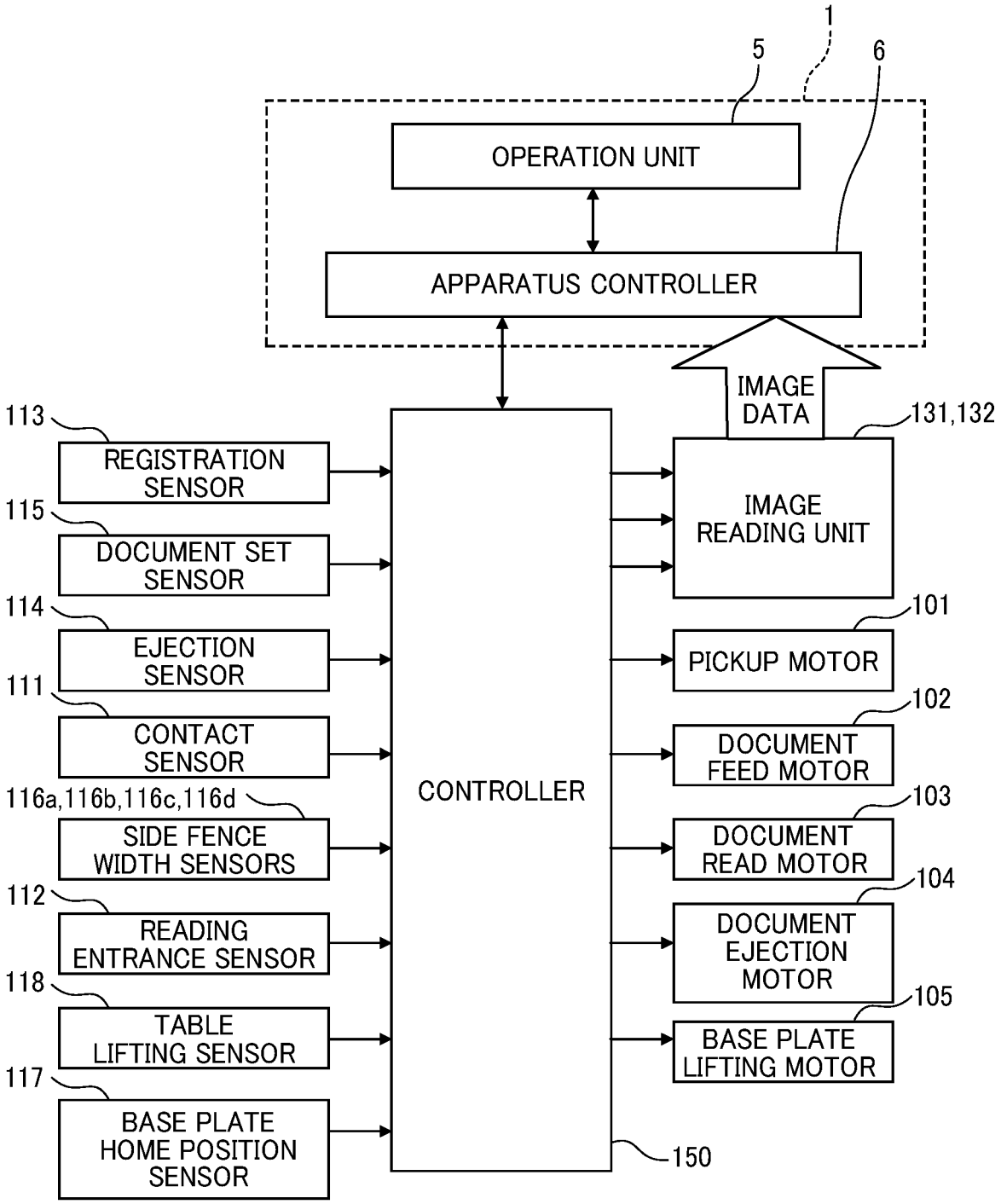
FIG. 3 is a block diagram illustrating a configuration of a controller incorporated in the ADF of FIG. 2.

FIG. 3 is a block diagram illustrating a configuration of a controller incorporated in the ADF 100 of FIG. 2.

As illustrated in FIG. 3, the ADF 100 further includes driving units (motors) that drive for a document feeding operation (document conveying operation) in each of the sections A to H, and a controller 150 including a circuit that controls various operations including operations of the driving units (motors). The driving units (motors) include a pickup motor 101, a document feed motor 102, a document read motor 103, a document ejection motor 104, and a base plate lifting motor 105.

The controller 150 supplies power to each section in the ADF 100, and controls each section in the ADF 100 based on a control signal transmitted from an apparatus controller 6 disposed in the housing of the copier 1.

When an image on an original document is read by the fixed document reading method, the original document is set on the exposure glass 4 and the ADF 100 is closed. The ADF 100 includes a pressure plate at the bottom to press the original document onto the exposure glass 4 when the image on the original document is read by the fixed document reading method. When a document reading instruction operation is performed on the operation panel 5 with the ADF 100 being closed, the original document is read while the first image reader 131 moves in the left-to-right direction in FIG. 1. In the fixed document reading method, for example, a gate signal is sent from the controller 150 to the first image reader 131 after completion of each reading of one A4 document to perform the reading control.

When an image on an original document is read by the sheet-through reading method, a document stack is set on the document table 120 (as a stacker) including the movable document table 121 with the document face (i.e., the first face) facing up. Further, side fences 122 serving as an aligner align the sheet width direction of the document stack (i.e., the direction orthogonal to the document conveyance direction), so as to position the side fences 122 (positioning of the side fences 122) by aligning with the sheet width direction of the document stack (sheet stack). The setting (set state) of the document stack is detected by a document set sensor 115 disposed on the movable document table 121. The detection result of the document set sensor 115 is sent to the apparatus controller 6 via an interface (I/F).

The movable document table (base plate) 121 is supported such that the rear end of the movable document table 121 (i.e., the rear side in the sheet conveyance direction) is rotatable around a rotary shaft 121*a*. The movable document table 121 rotates around the rotary shaft 121*a* by the base plate lifting motor 105 serving as a switcher so that the leading end of the movable document table 121 (i.e., the front side in the sheet conveyance direction) can be raised or lowered.

Before an original document is placed on the document table 120, the movable document table 121 of the document table 120 is located at a home position (i.e., the lowered position). The user sets the document stack on the document table 120 while the movable document table 121 is at the home position.

At this time, the uppermost face of the document stack on the movable document table 121 at the home position is separated from a pickup roller 141.

When the document set sensor 115 detects that the document stack is set on the document table 120, the controller 150 rotates the base plate lifting motor 105 in a forward direction to raise the movable document table 121 so that the uppermost face of the document stack on the movable document table 121 is brought to be in the contact state to contact the pickup roller 141 as a sheet feeding member. When the movable document table 121 is raised to push up the pickup roller 141 by the upper face of the document stack on the movable document table 121, this state is detected by a table lifting sensor 118. The controller 150 having received this detection signal stops the driving of the base plate lifting motor 105, so that the movable document table 121 is stopped at an appropriate position.

In other words, the table lifting sensor 118 detects that the movable document table 121 reaches an appropriate position and holds the upper face of the document stack to an appropriate height. More specifically, when the table lifting sensor 118 is turned on, the movable document table 121 stops raising. After the stop of the movable document table 121, as the feeding of the document stack is repeated. When the position of the upper face of the document stack is lowered and the table lifting sensor 118 is turned off, the movable document table 121 is raised again. When the table lifting sensor 118 is turned on again, the raising of the movable document table 121 is stopped. By repeating such a control operation, the position of the upper face of the document stack (i.e., the height of the uppermost original document of the document stack) is retained within a height range suitable for document feeding.

Instead of raising and lowering the movable document table 121, the table may be fixed and the pickup roller 141 may move up and down. Further, a pickup roller that moves up and down may be disposed below the fixed table so that the lowermost face of the document stack on the table on which the document stack is set can be fed by the sheet feeding member, and the pickup roller may enter an opening or a notch of the table from below and contact the lowermost face of the document stack on the table. Further, the table and the pickup roller projecting from the table may be raised together so that the uppermost face of the document stack contacts an upper face stopper while the document stack is being raised. Alternatively, the upper face stopper is lowered to contact the uppermost face of the document stack without raising or lifting the table and the pickup roller projecting from the table. By so doing, the sheet feeding member can feed the lowermost face of the document stack on the table on which the document stack is set. In this case, the contact state where the pickup roller and the original document or the document stack are in contact with each other is a state where the uppermost face of the document stack contacts the upper face upper face stopper and the separated state where the pickup roller and the original document or the document stack separate from each other is a state where the uppermost face of the document stack does not contact the upper face stopper and the pickup roller slightly contact with a light contact pressure that causes slippage so that the original document cannot be fed appropriately.

When the whole document stack set on the document table 120 is fed, the document set sensor 115 turns off. The controller 150 causes the base plate lifting motor 105 to rotate in reverse to lower the movable document table 121 to the home position so that the subsequent document stack can be set on the document table 120. In the present embodiment, a base plate home position sensor 117 is disposed below the movable document table 121 to detect that the movable document table 121 is at the home position. With the base plate home position sensor 117, the controller 150 can determine whether the movable document table 121 is at the home position.

When a document reading instruction operation is performed with (i.e., when a document feeding start instruction is input to) the operation panel 5 while the uppermost face of the document stack on the movable document table 121 and the pickup roller 141 are in the contact state, the apparatus controller 6 transmits a document feeding signal (i.e., a document feeding start signal) to the controller 150 via an interface.

In response to the instruction from the apparatus controller 6, the controller 150 starts the document feeding operation. The document feed motor 102 rotates in the forward direction to rotate the pickup roller 141 while the top face of the document stack on the movable document table 121 is retained at an appropriate height for document feeding, so that some original documents (desirably, one original document) on the document table 120 are picked up. The rotational direction of the pickup roller 141 is a direction in which the uppermost original document is conveyed toward the downstream side in the sheet conveyance direction. The separation roller pair 142 includes a feed roller 142A and a reverse roller 142B disposed opposite to the feed roller 142A. The feed roller 142A is rotated in the sheet conveyance direction as the document feed motor 102 rotates in the forward direction. The reverse roller 142B is rotated in the opposite direction to the sheet conveyance direction as the document feed motor 102 rotates in the forward direction.

After being separated from the other original documents of the document stack by the separation roller pair 142, the original document is further conveyed by the feed roller 142A to a contact sensor 111 where the contact sensor 111 detects the leading end of the original document. Then, the original document is further conveyed to contact a pullout roller pair 143 that is stopped rotating. The original document is then conveyed by a distance determined in advance based on the detection time of the contact sensor 111. By so doing, the leading end of the original document is pressed with a given amount of bend against the pullout roller pair 143. While the leading end of the original document is pressed against the pullout roller pair 143, the document feed motor 102 is stopped. As a result, the driving of the feed roller 142A that is conveying the original document is stopped.

In response to the detection of the leading end of the original document by the contact sensor 111, the controller 150 causes the pickup motor 101 to rotate to retract the pickup roller 141 from the top face of the original document. As a result, the original document is conveyed by the conveying force alone of the feed roller 142A of the separation roller pair 142. Due to such an operation, the leading end of the original document enters the nip region of the pullout roller pair 143 to align the leading end of the original document (i.e., skew correction). The pullout roller pair 143 has the skew correction function, is a pair of rollers that convey the original document subjected to the skew correction after separation to an intermediate roller pair 144, and is driven by the reverse rotation of the document feed motor 102. When the document feed motor 102 rotates in the reverse direction, the pullout roller pair 143 and the intermediate roller pair 144 are driven and the pickup roller 141 and the feed roller 142A are not driven.

The contact sensor 111 detects the leading end and the trailing end of the original document to detect the length of the original document in the sheet conveyance direction from a motor pulse. When the original document is conveyed from the registration section C to the sheet turning section D by driving of the pullout roller pair 143 and the intermediate roller pair 144, the conveyance speed of the original document in the registration section C is set to be higher than the conveyance speed of the original document in the first reading section E, so that the processing time for feeding the original document to the first reading section E is shortened. When the leading end of the original document is detected with a reading entrance sensor 112, deceleration of the original document is started to make the document conveyance speed equal to the reading conveyance speed before the leading end of the original document enters the nip region of a reading entrance roller pair 145. At the same time, the document read motor 103 is driven to rotate in the forward direction to drive the reading entrance roller pair 145, a first reading exit roller pair 146, and a second reading exit roller pair 147.

When the leading end of the original document is detected with a registration sensor 113, the controller 150 causes the original document to temporarily stop before the first reading section E and transmits a registration stop signal to the apparatus controller 6 via the interface. Subsequently, when the controller 150 receives the reading start signal from the apparatus controller 6, the controller 150 accelerates the conveyance speed of the original document that has been stopped due to the registration stop signal to a given conveyance speed and convey the original document until the leading end of the original document arrives at the first reading section E. The controller 150 transmits a gate signal indicating an effective image area of the first face of the original document in the sub-scanning direction to the first image reader 131 at the time when the leading end of the original document that is detected by the pulse count of the document read motor 103. The gate signal is continuously transmitted until the trailing end of the original document passes through the first reading section E.

In the case of single-sided document reading, the original document that has passed the first reading section E passes the second reading section F to a sheet ejection section G. At this time, when an ejection sensor 114 detects the leading end of the original document, the controller 150 drives the document ejection motor 104 to rotate in the forward direction to rotate an ejection roller pair 148. Further, the controller 150 counts the pulses of the document ejection motor 104 from when the leading end of the original document is detected with the ejection sensor 114, reduces the driving speed of the document ejection motor 104 immediately before the trailing end of the original document exits from the nip region between the ejection roller pair 148 based on the pulse count of the document ejection motor 104. Thus, the controller 150 controls the original document to be ejected onto the ejection tray of the sheet stacking section H not to jump out.

In the case of duplex document reading, the controller 150 detects the leading end of the original document that has passed the first reading section E with the ejection sensor 114, then counts the pulses of the document read motor 103. Then, the controller 150 transmits a gate signal indicating the effective image area in the sub-scanning direction to the second image reader 132 at a timing when the leading end of the original document arrives at the second reading section F. The gate signal is continuously transmitted until the trailing end of the original document passes through the second reading section F. Then, the original document that has passed through the second reading section F is conveyed to the sheet ejection section G.

A description is now given of the side fences 122 serving as an aligner that is disposed on the document table 120 of the ADF 100.

Figure 4:
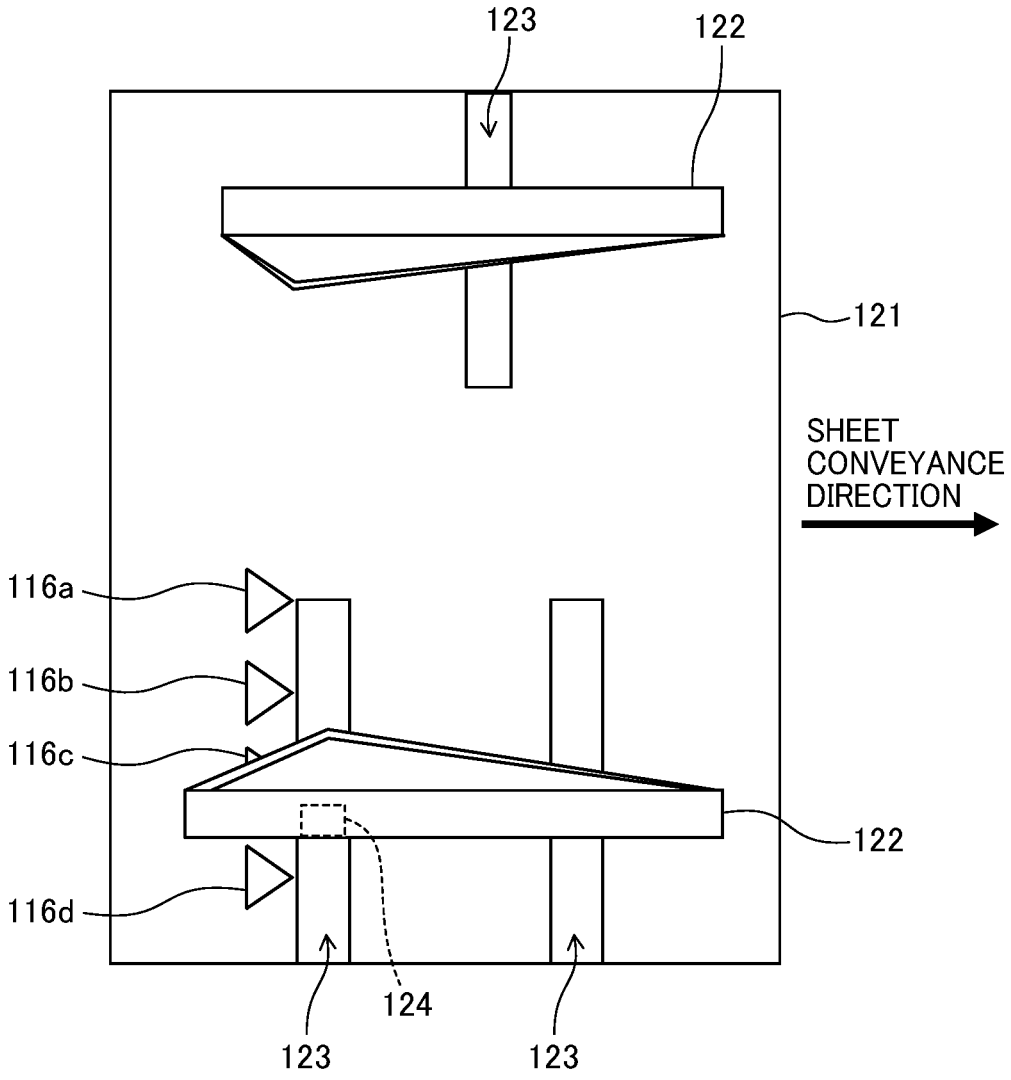
FIG. 4 is a plan view of a movable document table of a document table in the ADF.

FIG. 4 is a plan view of the movable document table 121 of the document table 120 according to the present embodiment.

Figure 5:
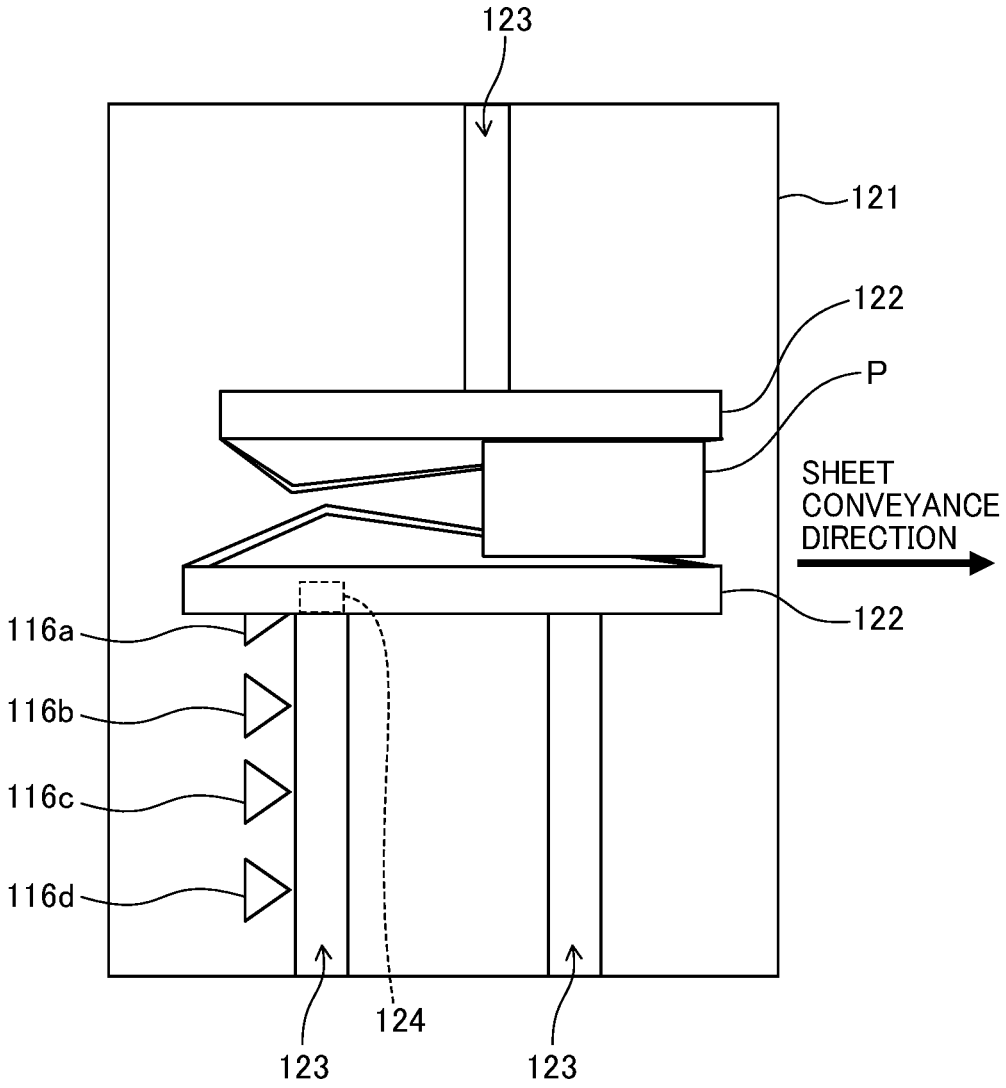
FIG. 5 is a plan view of the document table on which a document stack having the width size smaller than the given size in a sheet width direction of the document stack is set.

FIG. 5 is a plan view of the document table 120 according to the present embodiment, where a sheet smaller than the predetermined width size, in other words, a document stack P of original documents having a size smaller than the predetermined width size (i.e., the state where the positioning of the side fences is completed), is set on the document table 120.

The side fences 122 disposed on the document table 120 at the ADF 100 in the present embodiment align the position in the sheet width direction of the document stack P placed on the document table 120. The document table 120 of the ADF 100 may be an end reference type in which an end position on one side of the document stack P in the sheet width direction is used as a setting position reference of the document stack P or may be a center reference type in which a center position of the document stack P in the sheet width direction is used as a setting position reference of the document stack P. The present embodiment employs the center reference type.

In the case of the end reference type, a fixed fence is disposed on the document table 120 as a fixed aligner that contacts one side of the document stack P in the sheet width direction. One side fence 122 contacts the other side of the document stack P in the sheet width direction. In this case, when the document stack P is set on the document table 120, the document stack P is placed between the fixed fence and the side fence 122, and the side fence 122 is moved in the sheet width direction of the document stack P until the side fence 122 contacts the other side of the document stack P in the sheet width direction. Thus, the position of the document stack P in the sheet width direction is aligned by the fixed fence and the side fence 122.

In the case of the center reference type, as illustrated in FIGS. 4 and 5, two side fences 122 are disposed on the document table 120 as aligners, one side fence for contacting one side in the sheet width direction of the document stack P and the other side fence for contacting the other side in the sheet width direction of the document stack P, respectively. These two side fences 122 are movable in the sheet width direction of the original document by moving simultaneously with each other, so that the distance between the center position of the original document in the sheet width direction and each of the side fences 122 is constantly the same. In this case, when the document stack P is set on the document table 120, the document stack P is placed between the two side fences 122, and then the two side fences 122 are moved along the sheet width direction of the document stack P until the document stack P is sandwiched between the two side fences 122 from both sides in the sheet width direction. As a result, the position in the sheet width direction of the document stack P is aligned by the two side fences 122.

In the present embodiment, guide grooves 123 are formed in the movable document table 121 of the document table 120 to guide the side fences 122 to move in the sheet width direction of the original document (document stack P).

As illustrated in FIGS. 4 and 5, the guide grooves 123 extend in the sheet width direction of the original document and are open in the movable document table 121. A guide pin provided on the lower part of each of the side fences 122 is engaged with the guide grooves 123. Due to such a configuration, the side fences 122 can move in the sheet width direction of the original document along the guide grooves 123.

In the present embodiment, four side fence width sensors 116*a*, 116*b*, 116*c*, and 116*d* are disposed on the movable document table 121 along the guide grooves 123. Each of the side fence width sensors 116*a*, 116*b*, 116*c*, and 116*d* includes an optical sensor and detects a feeler 124 attached to the guide pin of the side fence 122 to detect the position of the side fences 122 in the sheet width direction of the original document. The number of the side fence width sensors 116*a*, 116*b*, 116*c*, and 116*d* is not limited to four and may be one or two or more.

In the present embodiment, each of the side fence width sensors 116*a*, 116*b*, 116*c*, and 116*d* is turned on when detecting the feeler 124 of the side fence 122, and the detection result is transmitted to the controller 150. The controller 150 serves as a position sensor with the side fence width sensors 116*a*, 116*b*, 116*c*, and 116*d* to acquire the position of the side fences 122 in the sheet width direction of the original document depending on which one of the four side fence width sensors 116*a*, 116*b*, 116*c*, and 116*d* is turned on.

Figure 6:
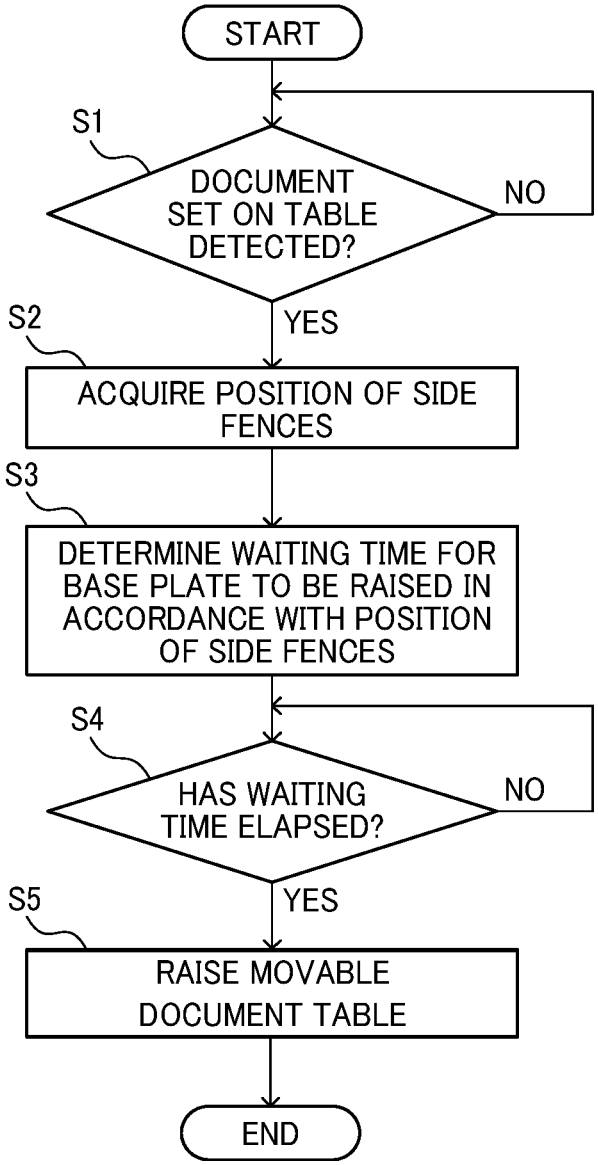
FIG. 6 is a flowchart of the flow of a raising operation of the movable document table (base plate), according to the present embodiment.

FIG. 6 is a flowchart of the flow of a raising operation of the movable document table (base plate) 121 according to the present embodiment.

In the present embodiment, when the user places the document stack P on the document table 120, the controller 150 determines whether the document stack P is detected by the document set sensor 115 (step S1). When the document stack P is not detected by the document set sensor 115 (NO in step S1), step S1 is repeated until the document stack P is detected by the document set sensor 115. On the other hand, when the document stack P is detected by the document set sensor 115 (YES in step S1), the controller 150 acquires the position of the side fences 122 in the sheet width direction of the original document (step S2), and determines the given waiting time for the base plate to be raised in accordance with the position of the side fences 122 (step S3). Then, the controller 150 determines whether the given waiting time has elapsed from the detection of the document stack P with the document set sensor 115 (step S4). When the waiting time has not elapsed (NO in step S4), step S4 is repeated until the waiting time elapses. On the other hand, when the given waiting time has elapsed (YES in step S4), the controller 150 drives the base plate lifting motor 105 to rotate in the forward direction to raise the movable document table 121, so that the uppermost face of the document stack P on the movable document table 121 contacts the pickup roller 141 in the contact state (i.e., the raised position) and prepares for the document reading instruction operation (i.e., the document feeding start instruction) (step S5).

When the user sets the document stack P on the document table 120 of the ADF 100, the user typically places the document stack P on the document table 120 (i.e., the document placing operation), and then performs positioning of the side fences 122 by bringing the side fences 122 close to the document stack P to align the side fences 122 to the width of the document stack P (i.e., the positioning operation). The above-described way of setting the document stack may result in an inconvenience that the user cannot complete the positioning operation on the side fences 122 before the above-described given waiting time has elapsed.

If the movable document table 121 is raised to the raised position before the positioning operation on the side fences 122 is completed (in other words, if the contact state occurs), the document stack P would not move since the document stack P is sandwiched between the movable document table 121 and the pickup roller 141 when moving the side fences 122 toward the document stack P. As a result, the positioning operation on the side fences 122 cannot be completed. If the document feeding is started before the positioning operation of the side fence 122 is completed, the alignment of the position of the document stack P in the sheet width direction with the side fences 122 is insufficient, and it is likely to cause a document feeding failure such as a skew of the original document.

When a small-size original document having a document width size is smaller than a given document size, it is likely to cause an inconvenience that the user cannot complete the positioning operation on the side fences 122 before the movable document table 121 reaches the raised position (the contact state). The above-described inconvenience may be caused due to the reasons described below.

For example, a small-size original document such as a postcard-size document is typically used less frequently than a large-size original document having a document width size equal to or greater than a predetermined size (for example, an A4 size document having a document width size to be vertically long). For this reason, the position of the side fences 122 immediately before the small-size original document is placed on the document table 120 often remains at the position corresponding to the large-size document. When a small-size original document is placed on the document table 120, the side fences 122 need to be moved more when compared with cases in which a large-size original document is placed on the document table 120, in order to move the side fences 122 closer to the document stack P for alignment. As a result, as the width size of the document stack P is smaller, the positioning operation on the side fences 122 is likely to take a longer time.

In addition, as the width size of the document stack P is smaller, skew of the document stack P is likely to occur unless the side fences 122 are positioned more accurately to align the position in the sheet width direction of the document stack P. As described above, as the width size of the original document is smaller, the higher positioning accuracy of the side fences 122 is required. For this reason, as the width size of the document stack P is smaller, the positioning operation on the side fences 122 is likely to take a longer time.

For the above-described reasons, as the width size of the document stack is smaller, it is more difficult for the user to complete the positioning operation on the side fences 122 before the movable document table 121 reaches the raised position (i.e., the contact state).

To address this inconvenience, the ADF 100 according to the present embodiment is provided with a size specifying unit and a timing changer (i.e., the controller 150). The size specifying unit specifies the width size of the document stack P placed on the document table 120. When the width size of the document stack P specified by the size specifying unit is smaller than the given size, the timing changer (i.e., the controller 150) delays the time (i.e., the switching completion time) that the movable document table 121 on which the document stack P smaller than a given size is placed reaches the raised position (i.e., the contact state) to be later than the time until the movable document table 121 on which the document stack P having the given size or a greater size is placed reaches the raised position. The above-described configuration can prevent occurrence of an inconvenience in which the user cannot complete the positioning operation of the side fences 122 before the movable document table 121 is raised from the separated state to the raised position (i.e., the contact state), without waiting for the document feeding start instruction after the small-size original document (or the document stack P) is placed on the document table 120.

The size specifying unit according to the present embodiment includes the side fence width sensors 116*a*, 116*b*, 116*c*, and 116*d* each detecting the position of the side fences 122 in the sheet width direction of the original document (or the document stack P) and uses the detection results of the side fence width sensors 116*a*, 116*b*, 116*c*, and 116*d*. More specifically, when the document set sensor 115 detects the document stack P placed on the document table 120 (YES in step S1), the controller 150 acquires the position of the side fences 122 in the sheet width direction of the document stack P from the detection results of the side fence width sensors 116*a*, 116*b*, 116*c*, and 116*d* (step S2). In the present embodiment, the width size of the document stack P placed on the document table 120 is estimated (specified) from the position of the side fences 122 in the sheet width direction of the document stack P when the document stack P is placed on the document table 120, in other words, when the document set sensor 115 detects the document stack P.

Specifically, when setting the document stack P of small-size original documents on the document table 120, the user typically performs an operation of adjusting the position of the side fences 122 to an approximate width of the document stack P (i.e., a rough adjustment operation) prior to a sheet stacking operation of stacking the document stack P on the document table 120. As a result, by acquiring the position of the side fences 122 in the sheet width direction of the document stack P during the period from when the document stack P is placed on the document table 120 to when the movable document table 121 starts moving up, the width size of the document stack P placed on the document table 120 can be specified before the movable document table 121 starts moving up. In other words, in consideration of the above-described typical work contents of the user, as the width size of the document stack P corresponding to the position of the side fences 122 in the sheet width direction of the document stack P during the period decreases, it is estimated (specified) that the width size of the document stack P placed on the document table 120 is smaller.

Figure 7:
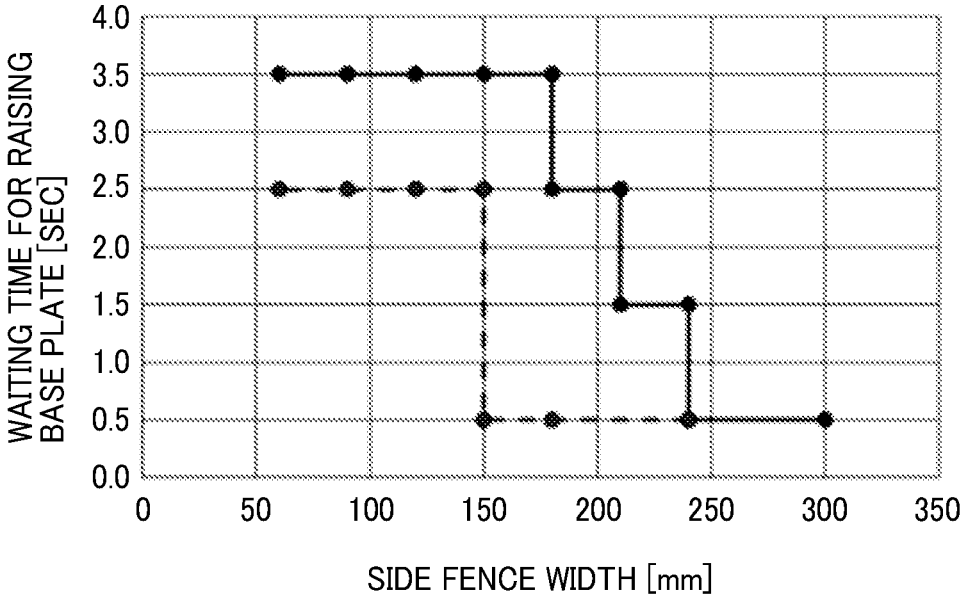
FIG. 7 is a graph of a relation of the width between two side fences and the waiting time for the start of raising the movable document table (base plate), according to the present embodiment.

FIG. 7 is a graph of a relation of the distance between the two side fences 122 in the sheet width direction of the original document (i.e., the position of the side fences 122 in the sheet width direction of the original document) and the waiting time for the start of raising the movable document table (base plate) 121, according to the present embodiment.

In the present embodiment, in accordance with the data of the graph illustrated in FIG. 7, the controller 150 determines the waiting time for the start of raising the movable document table (base plate) 121 depending on the position of the side fences 122 in the sheet width direction of the original document (S3). According to the present embodiment, as illustrated in the graph of FIG. 7, the waiting time for the start of raising the movable document table (base plate) 121 changes in four phases depending on the distance between the two side fences 122 in the sheet width direction of the original document (i.e., the position of the side fences 122 in the sheet width direction of the original document).

Specifically, when the distance between the two side fences 122 in the sheet width direction of the original document is 240 [mm] or greater, the controller 150 determines the waiting time for the start of raising the movable document table (base plate) 121 to be 0.5 [sec]. The controller 150 determines the waiting time for the start of raising the movable document table (base plate) 121 to be 1.5 [sec] when the distance between the two side fences 122 in the sheet width direction of the original document is less than 240 [mm] (and equal to or greater than 210 [mm]), so that the waiting time is later than the waiting time when the distance between the two side fences 122 in the sheet width direction of the original document is equal to or greater than 240 [mm]. The controller 150 determines the waiting time for the start of raising the movable document table (base plate) 121 to be 2.5 [sec] when the distance between the two side fences 122 in the sheet width direction of the original document is less than 210 [mm] (and equal to or greater than 180 [mm]), so that the waiting time is later than the waiting time when the distance between the two side fences 122 in the sheet width direction of the original document is equal to or greater than 210 [mm]. The controller 150 determines the waiting time for the start of raising the movable document table (base plate) 121 to be 3.5 [sec] when the distance between the two side fences 122 in the sheet width direction of the original document is less than 180 [mm], so that the waiting time is later than the waiting time when the distance between the two side fences 122 in the sheet width direction of the original document is equal to or greater than 180 [mm].

In the present embodiment, as the width size of the document stack P that is estimated from the position of the side fences 122 in the sheet width direction of the original document decreases, the waiting time for the start of raising the movable document table (base plate) 121 becomes longer. For this reason, according to the present embodiment, as the width size of the document stack P decreases, the time (i.e., the switching completion is more delayed. As a result, even when a small-size original document that requires longer time for the positioning operation of the side fences 122 is set, the user can easily complete the positioning operation of the side fences 122 before the movable document table 121 reaches the raised position (i.e., the contact state).

Even in a typical configuration in which the waiting time for the start of raising the movable document table (base plate) 121 is fixed, if the waiting time is set to be sufficiently long, the user can easily complete the positioning operation of the side fences 122 before the movable document table 121 reaches the raised position. However, in this case, the waiting time becomes long even when the user does not take time to complete the positioning operation of the side fences 122 with, for example, a large-size original document. Such an operation may reduce the advantage of enhancement in productivity (i.e., a reduction in time from when the document reading instruction operation or the document feeding start instruction is issued to when the original document is fed) by completing the raising of the movable document table 121 before issuance of the document reading instruction operation (the document feeding start instruction). According to the present embodiment, the user can easily complete the positioning operation of the side fences 122 before the movable document table 121 reaches the raised position while maintaining the advantage of enhancement of the productivity.

In the present embodiment, the waiting time for the start of raising the movable document table (base plate) 121 is changed in four phases depending on the distance between the two side fences 122 in the sheet width direction of the original document (i.e., the position of the side fences 122 in the sheet width direction of the original document), but the number of phases is not limited to four phases. For example, as indicated by a broken line in FIG. 7, the threshold value may be changed in two phases (with one threshold value).

Further, in the present embodiment, even when the width size of the original document is the smallest (i.e., when the distance between the two side fences 122 in the sheet width direction of the original document is less than 180 [mm]), the controller 150 determines the waiting time for the start of raising the movable document table (base plate) 121 to be 3.5 [sec], but the waiting time is not limited to 3.5 [sec]. In other words, for example, when the width size of the original document is the smallest, the movable document table 121 may be raised after the document reading instruction operation (i.e., the document feeding start instruction) is made to the operation panel 5, in other words, the movable document table 121 may not be raised before the document feeding start instruction is issued.

In the present embodiment, the position of the side fences 122 in the sheet width direction of the original document is detected discontinuously (in four stages) by using the four side fence width sensors 116*a*, 116*b*, 116*c*, and 116*d*. However, the configuration for detecting the position of the side fences 122 in the sheet width direction of the original document is not limited to the configuration including the side fence width sensors 116*a*, 116*b*, 116*c*, and 116*d*.

For example, a configuration using a variable resistor whose electrical resistance value changes in accordance with the position of the side fences 122 in the sheet width direction of the original document may be employed. This configuration can detect the position of the side fences 122 in the sheet width direction of the original document in more detail than the above-described configuration according to the present embodiment, and is easily achievable.

Figure 8:
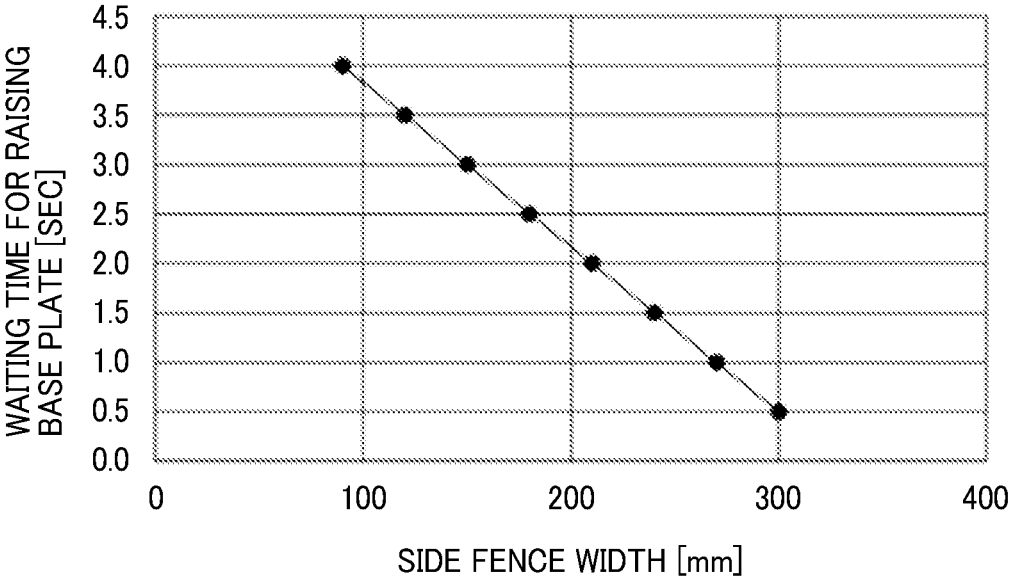
FIG. 8 is a graph of another relation of the width between two side fences and the waiting time for the start of raising the movable document table (base plate), according to the present embodiment.

FIG. 8 is a graph of another relation of the width between the two side fences 122 and the waiting time for the start of raising the movable document table (base plate) 121, according to the present embodiment.

As described above, in the case of such a configuration in which the position of the side fences 122 in the sheet width direction of the original document is continuously detected, the waiting time may be changed in more detail depending on the position of the side fences 122 in the sheet width direction of the original document, in accordance with, for example, the data of the graph illustrated in FIG. 8.

The present embodiment employs a method of estimating (specifying) the width size of the document stack P placed on the document table 120 as the method of specifying the width size of the document stack P placed on the document table 120 based on the position of the side fences 122 in the sheet width direction of the original document. However, the method of estimating (specifying) the width size of the document stack P placed on the document table 120 is not limited to the above-described method.

Figure 9:
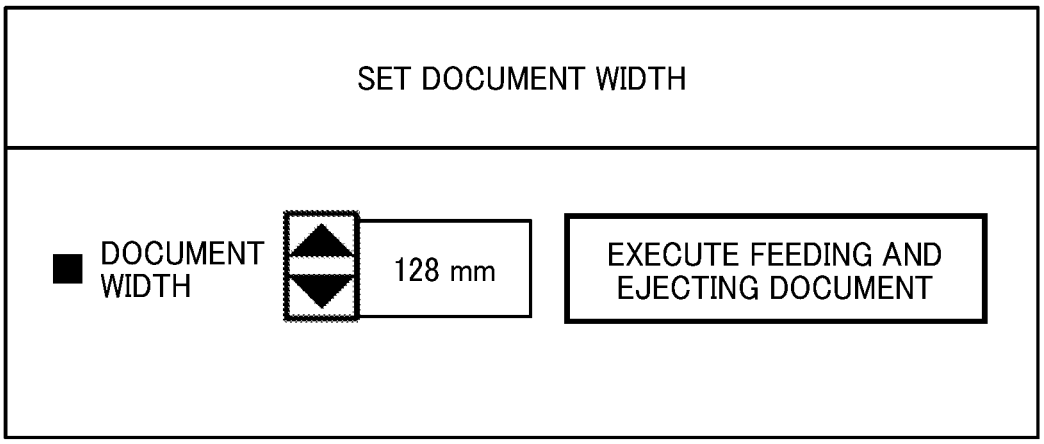
FIG. 9 is a diagram illustrating an operation screen with which a user inputs the width size of the document stack.

FIG. 9 is a diagram illustrating an operation screen with which a user inputs the width size of the document stack.

For example, the method of estimating (specifying) the width size of the document stack P placed on the document table 120 may be a method of inputting the width size of the document stack P by the user operating the operation panel 5 on which the operation screen illustrated in FIG. 9 is displayed and specifying the width size of the document stack P placed on the document table 120 based on the input result (i.e., the size specifying information). In the example of the operation screen illustrated in FIG. 9, the user appropriately selects the numerical value of the width of the original document displayed on the operation screen of the operation panel 5, and performs the document reading instruction operation (i.e., the document feeding start instruction) by operating the "EXECUTE FEEDING AND EJECTING DOCUMENT" on the operation screen. Instead of operating the operation screen, the user may mechanically operate a switch to input the width size of the document stack P.

As the a method of specifying the width size of the document stack P placed on the document table 120, the width size of the document stack P may be directly detected by employing the configuration in which, for example, multiple sensors such as optical sensors that detect the document stack P of the document table 120 are aligned along the sheet width direction of the original document to detect the width size of the document stack P placed on the document table 120 based on the detection results of the sensors. However, the document stack P on the document table 120 before being aligned by the side fences 122 is often in a state where the end in the sheet width direction is not aligned or in a state where the position of replacement of the document stack P on the document table 120 is out of the reference position. The document stack P in the states described above is highly unlikely to correctly detect the width size of the document stack P with the configuration in which the width size of the document stack P is directly detected, and is likely to cause false detection.

Modification 1

A description is now given of an elevating operation of the movable document table 121 according to a modification of an embodiment of the present disclosure. This modification is referred to as "Modification 1".

Figure 10:
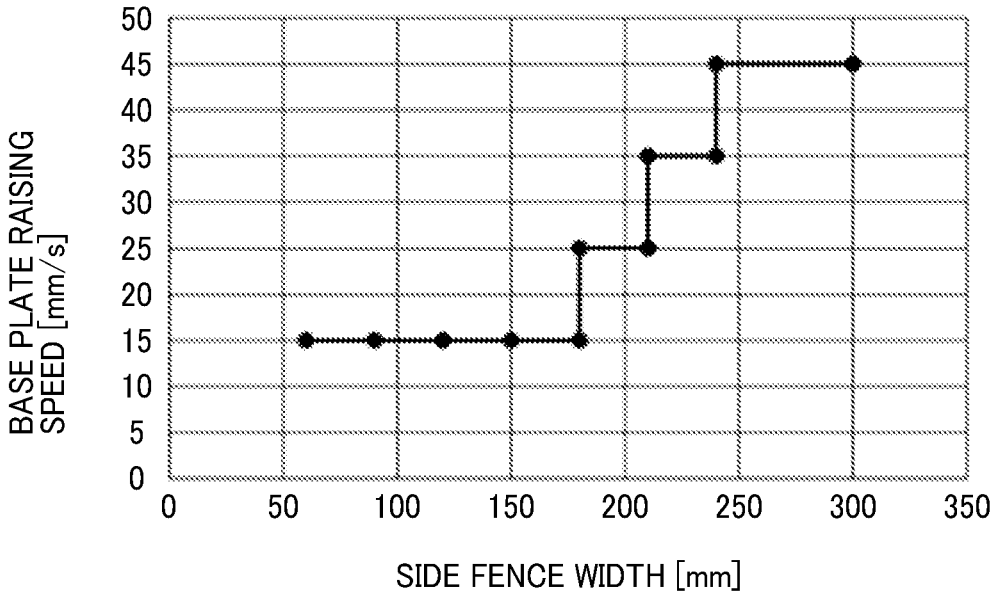
FIG. 10 is a graph of a relation of the width between the two side fences and the raising speed the movable document table (base plate), according to Modification 1 of the present disclosure.

FIG. 10 is a graph of a relation of the width between the two side fences 122 and the raising speed the movable document table (base plate) 121, according to Modification 1 of the present disclosure.

Figure 11:
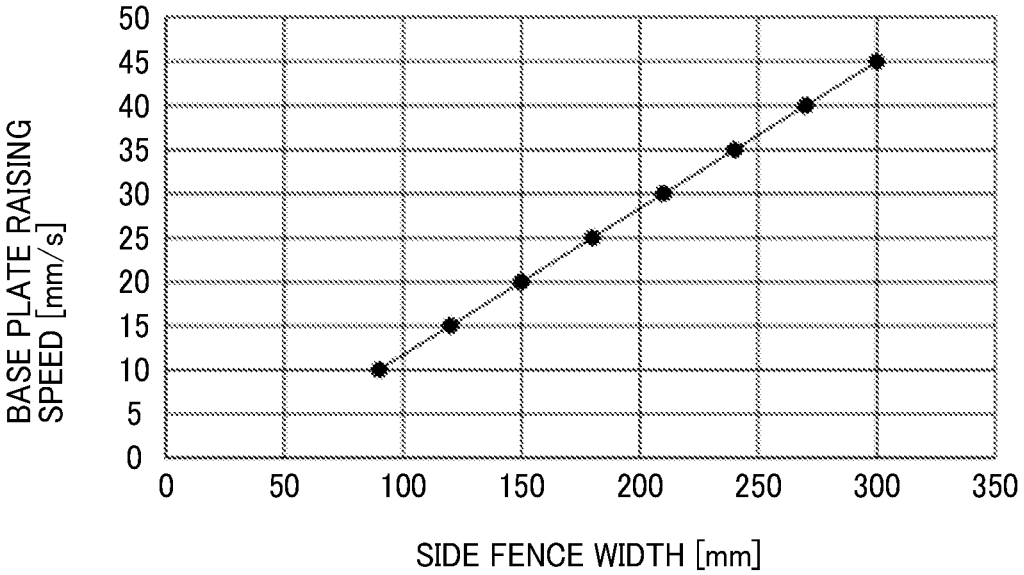
FIG. 11 is a graph of another relation of the width between the two side fences and the raising speed the movable document table (base plate), according to Modification 1 of the present disclosure.

FIG. 11 is a graph of another relation of the width between the two side fences 122 and the raising speed the movable document table (base plate) 121, according to Modification 1 of the present disclosure.

The above-described embodiment employs a method of taking a longer waiting time for the start of raising the movable document table (base plate) 121 as the method of delaying the time (i.e., the switching completion time) that the movable document table 121 reaches the raised position (i.e., the contact state). Modification 1 employs a method of slowing the raising speed of the movable document table (base plate) 121 as the method of delaying the time (i.e., the switching completion time) that the movable document table 121 reaches the raised position (i.e., the contact state), as illustrated in the graph of FIG. 10.

According to Modification 1, even if the waiting time for the start of raising the movable document table (base plate) 121 is fixed, the time (i.e., the switching completion can be delayed. When the position of the side fences 122 in the sheet width direction of the original document is continuously detected, for example, the graph illustrated in FIG. 11 may be used.

Figure 12:
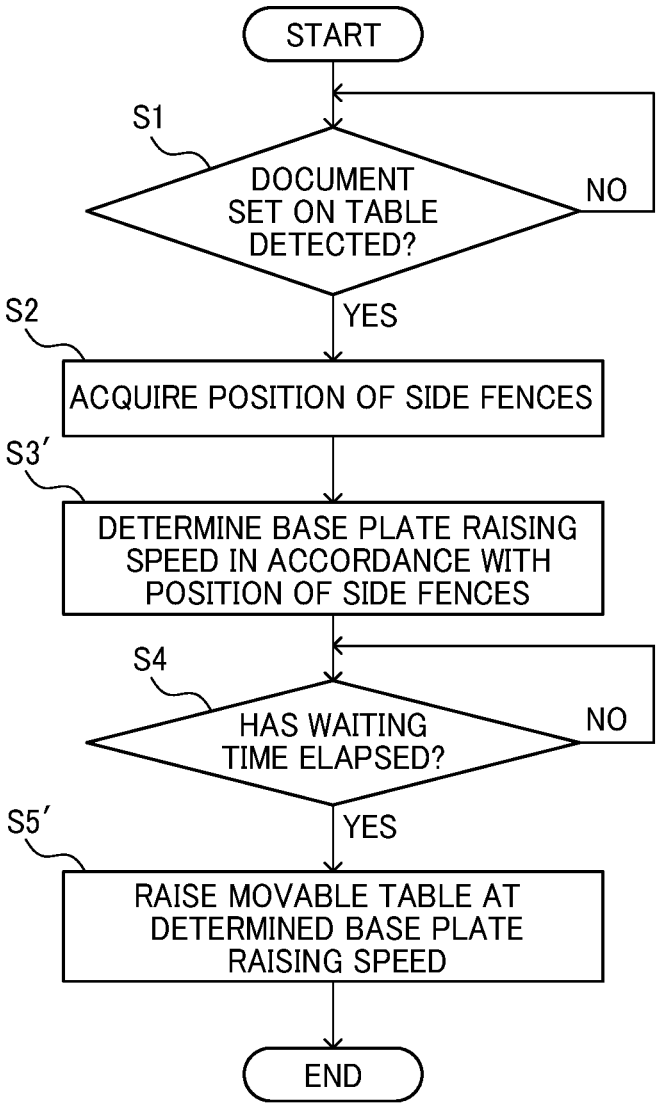
FIG. 12 is a flowchart of the raising operation of the movable document table (base plate) according to Modification 1 of the present disclosure.

FIG. 12 is a flowchart of the raising operation of the movable document table (base plate) 121 according to Modification 1 of the present disclosure.

In Modification 1, in accordance with the data of the graph illustrated in FIG. 10, the controller 150 determines the raising speed of the movable document table (base plate) 121 depending on the position of the side fences 122 in the sheet width direction of the original document (step S3'). When the given waiting time (fixed) has elapsed from the detection of the document stack P with the document set sensor 115 (YES in step S4), the controller 150 drives the base plate lifting motor 105 to rotate in the forward direction at the number of rotations corresponding to the determined raising speed to raise the movable document table 121, so that the uppermost face of the document stack P on the movable document table 121 contacts the pickup roller 141 in the contact state (i.e., the raised position) (step S5').

In Modification 1, the raising speed of the movable document table (base plate) 121 decreases as the width size of the document stack P estimated from the position of the side fences 122 in the sheet width direction of the original document is reduced. As a result, in Modification 1, as the width size of the document stack P decreases, the time (i.e., the switching completion time) that the movable document table 121 reaches the raised position (i.e., the contact state) is more delayed. As a result, even when a small-size original document that requires longer time for the positioning operation of the side fences 122 is set, the user can easily complete the positioning operation of the side fences 122 before the movable document table 121 reaches the raised position (i.e., the contact state).

Modification 2

A description is now given of an elevating operation of the movable document table 121 according to another modification of an embodiment of the present disclosure. This modification is referred to as "Modification 2".

In the above-described embodiment, when the detected distance between the side fences 122 in the sheet width direction of the original document (i.e., the position of the side fences 122 in the sheet width direction) is relatively narrow, in other words, when the width size of the document stack P is smaller than the given size, the time (i.e., the switching completion time) that the movable document table 121 reaches the raised position (i.e., the contact state) is delayed. In Modification 2, when an error between the detected distance between the side fences 122 in the sheet width direction of the original document (i.e., the position of the side fences 122 in the sheet width direction) and the width size of the document stack P (i.e., the position of the side fences 122 in the sheet width direction corresponding to the width size of the document stack P) is greater than a given error, the time (i.e., the switching completion time) that the movable document table 121 reaches the raised position (i.e., the contact state) is delayed.

In Modification 2, the ADF 100 further includes a position sensor (the four side fence width sensors 116*a*, 116*b*, 116*c*, and 116*d*) that acquires the width (i.e., the position in the sheet width direction of the original document) of the side fence 122 and a size specifying unit (the operation panel 5) that specifies the width size of the document stack P placed on the document table 120. As in the above-described embodiment, the position sensor (i.e., the controller 150) acquires the position of the side fences 122 in the sheet width direction of the original document based on the detection results of the four side fence width sensors 116*a*, 116*b*, 116*c*, and 116*d* detecting a feeler 124 attached to the guide pin of the side fences 122.

The size specifying unit according to Modification 2 needs to use a unit separate from the position sensor. As a result, the configuration of Modification 2 employs, for example, the operation panel 5 serving as an information receiver with the operation screen as illustrated in FIG. 9 being displayed so that the user inputs the width size of the document stack P via the operation screen, and a size specifying unit that specifies the width size of the document stack P placed on the document table 120 from the input result.

Figure 13:
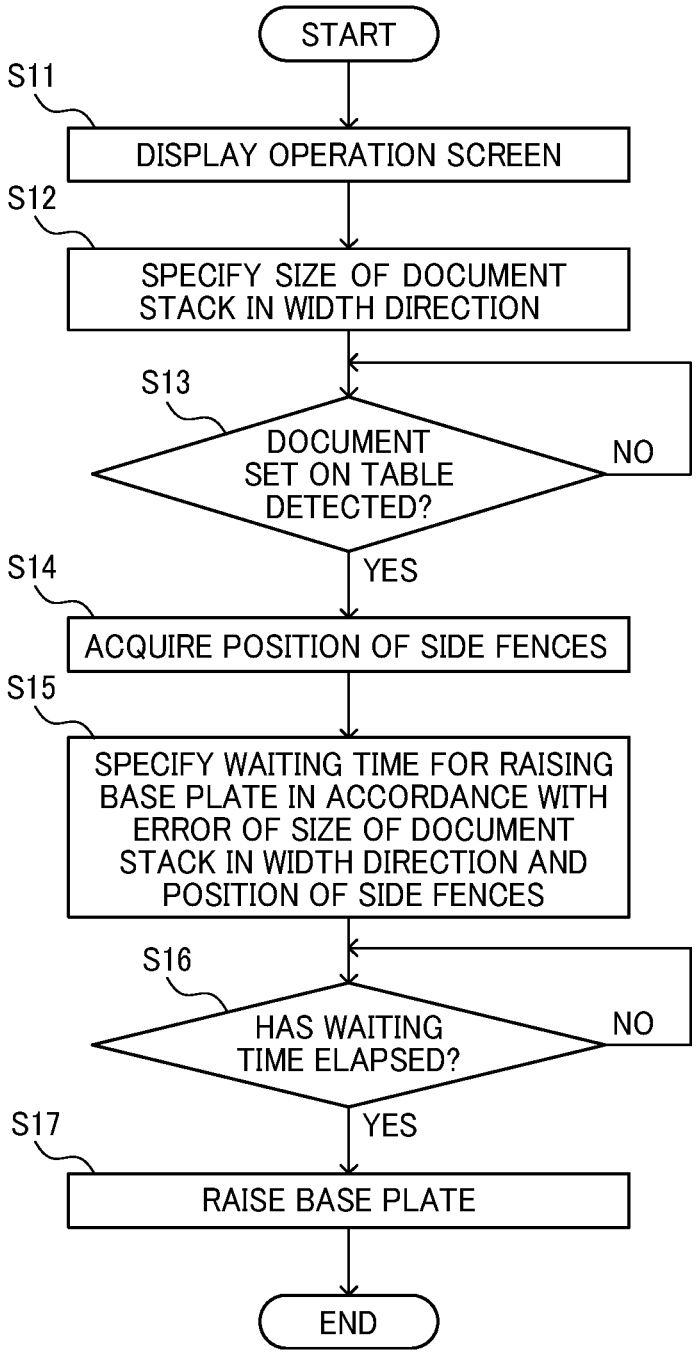
FIG. 13 is a flowchart of the raising operation of the movable document table (base plate) according to Modification 2 of the present disclosure.

FIG. 13 is a flowchart of the raising operation of the movable document table (base plate) 121 according to Modification 2 of the present disclosure.

Before or after the user places the document stack P on the document table 120, the controller 150 causes the operation panel 5 to display the operation screen as illustrated in FIG. 9 (step S11). In response to this operation, when the user inputs the width size of the document stack P placed on the document table 120 to the operation panel 5, the controller 150 specifies the width size of the document stack P placed on the document table 120 based on the input result (step S12).

When the user places the document stack P on the document table 120, the controller 150 determines whether the document set sensor 115 detects the document stack P (step S13). When the document set sensor 115 has not detected the document stack P (NO in step S13), step S13 is repeated until the document set sensor 115 detects the document stack P. On the other hand, when the document set sensor 115 detects the document stack P (YES in step S13), the controller 150 acquires the position of the side fences 122 in the sheet width direction of the original document based on the detection results of the side fence width sensors 116*a*, 116*b*, 116*c*, and 116*d* (step S14).

Then, the controller 150 determines the waiting time for the start of raising the movable document table (base plate) 121 in accordance with the error between the width size of the specified document stack P (i.e., the position of the side fences 122 in the sheet width direction corresponding to the width size of the specified document stack P) and the position of the side fences 122 in the sheet width direction of the original document (step S15). For example, the controller 150 changes the waiting time for the start of raising the movable document table (base plate) 121 to increase in phases or continuously as this error increases.

Then the controller 150 determines whether the determined waiting time has elapsed since the detection of the document stack P with the document set sensor 115 (step S16). When the determined waiting time has not elapsed (NO in step S16), step S16 is repeated until the determined waiting time elapses. On the other hand, when the determined waiting time has elapsed (YES in step S16), the controller 150 drives the base plate lifting motor 105 to rotate in the forward direction to raise the movable document table (base plate) 121, so that the uppermost face of the document stack P on the movable document table 121 contacts the pickup roller 141 in the contact state (i.e., the raised position) (step S17).

In Modification 2, as the error between the detected width between the side fences 122 (i.e., the position of the side fences 122 in the sheet width direction) and the width size of the document stack P (i.e., the position of the side fences 122 in the sheet width direction corresponding to the width size of the document stack P) increases, the time (i.e., the switching completion time) that the movable document table 121 reaches the raised position (i.e., the contact state) is more delayed. As the error increases, the side fences 122 needs to be moved largely to the document stack P for positioning. For this reason, as the error increases, the positioning operation on the side fences 122 is likely to take a longer time. As a result, with the configuration of Modification 2, even when the error increases and the positioning operation on the side fences 122 takes a longer time, the user can easily complete the positioning operation of the side fences 122 before the movable document table 121 reaches the raised position (i.e., the contact state).

In the present embodiment (including the modifications), the configuration was given of setting an original document (sheet) that is an object to be read by the image reader included in the ADF 100 on the document table 120. However, the present disclosure is not limited to this configuration. For example, the present disclosure is also applicable to the configuration in which a recording sheet (sheet) on which an image is formed by the image forming device 3 is set on a manual tray. To be more specific, the present disclosure is also applicable to the configuration in which sheet trays 21 and 22 provided for the sheet feeding device 2 of the copier 1 or the manual tray of the copier 1.

Although specific embodiments are described, the embodiments according to the present disclosure are not limited to those specifically described herein. Several aspects of the drive device and the image forming apparatus are exemplified as follows.

First Aspect

In the first aspect of the present disclosure, a sheet feeder (for example, the original document setter A of the ADF 100) includes a stacker (for example, the document table 120), a sheet feeding member (for example, the pickup roller 141), an aligner (for example, the side fences 122), a switcher (for example, the base plate lifting motor 105), a size specifying unit (for example, the side fence width sensors 116*a*, 116*b*, 116*c*, 116*d*, the operation panel 5), and circuitry (for example, the controller 150). The stacker stacks a sheet stack (for example, the document stack P). The sheet feeding member contacts the sheet stack on the stacker to feed each sheet of the sheet stack. The aligner is movable in a sheet width direction of the sheet stack and align a position in the sheet width direction of the sheet stack on the stacker. The switcher switches the aligner from a separation state to a contact state without waiting for a feeding start instruction after the sheet stack is stacked on the stacker. The sheet stack on the stacker and the sheet feeding member separate from each other in the separation state. The sheet stack on the stacker and the sheet feeding member contact with each other in the contact state. The size specifying unit specifies a size in the sheet width direction of the sheet stack on the stacker. The circuitry delays a switching completion time from the separation state to the contact state when the size in the sheet width direction of the sheet stack specified by the size specifying unit is smaller than a given size, to be later than a switching completion time when the size in the sheet width direction of the sheet stack is equal to or greater than the given size.

In general, a user places the sheet stack on the stacker (i.e., a sheet stacking operation), and then moves the aligner to the sheet stack to adjust the aligner to the width of the sheet stack, in other words, positions the aligner (i.e., a positioning operation of the aligner). In a typical configuration in which the separation state where the sheet stack on the stacker and the sheet feeding member are separated from each other is switched to the contact state where the sheet stack on the stacker and the sheet feeding member contact with each other, it is likely that the sheet stack on the stacker and the sheet feeding member contact are brought to the contact state before completion of the positioning operation of the aligner. If the sheet stack on the stacker and the sheet feeding member contact are brought to the contact state before the positioning operation of the aligner is completed, the sheet stack would not move since the sheet stack is sandwiched between the stacker and the sheet feeding member when moving the aligner toward the sheet stack. As a result, the positioning operation on the aligner cannot be completed. If the feeding of the sheet stack is started before the positioning operation of the aligner is completed, the alignment of the position in the sheet with the aligner is insufficient, and it is likely to cause a sheet feeding failure such as a skew of a sheet or sheets of the sheet stack.

The inventor of the present disclosure has found that, when a small-size original document having a document width size is smaller than a given document size, it is likely to cause an inconvenience that the user cannot complete the positioning operation on the aligner before the stacker is brought into the contact state. The above-described inconvenience may be caused due to the reasons described below.

Generally, a small-size sheet (for example, a postcard size) whose width size is smaller than a given size is used less frequently than a large-size sheet (for example, a A4 size) whose width size is equal to or larger than the given size. For this reason, the position of the aligner immediately before the small-size sheet is placed on the stacker often remains at the position corresponding to the large-size sheet. When a small-size sheet is placed on the stacker, the aligner needs to be moved more when compared with cases in which a large-size sheet is placed on the stacker, in order to move the aligner closer to the sheet stack for positioning. In addition, as the width size of the sheet stack is smaller, skew of the sheet stack is likely to occur unless the aligner is positioned more accurately to align the position in the sheet width direction of the sheet stack. As described above, as the width size of the sheet stack is smaller, the higher positioning accuracy of the aligner is required. For this reason, as the width size of the sheet stack is smaller, the positioning operation on the aligner is likely to take a longer time. For the above-described reasons, as the width size of the document stack is smaller, it is more difficult for the user to complete the positioning operation of the aligner before the stacker is brought into the contact state.

To address this inconvenience, the sheet feeder according to the first aspect delays the switching completion time from the separation state to the contact state when the size in the sheet width direction of the sheet stack specified by the size specifying unit is smaller than the given size, to be later than the switching completion time when the size in the sheet width direction of the sheet stack is equal to or greater than the given size. According to this configuration, the sheet feeder can prevent occurrence of an inconvenience in which the user cannot complete the positioning operation of the aligner before the stacker is brought into the contact state when the sheet stack having a small size is stacked on the stacker.

Second Aspect

In the second aspect of the present disclosure, according to the first aspect, the sheet feeder (for example, the original document setter A of the ADF 100) further includes a position sensor (for example, the side fence width sensors 116*a*, 116*b*, 116*c*, 116*d*) disposed on the stacker (for example, the document table 120). The position sensor acquires a position of the aligner (for example, the side fences 122) in the sheet width direction of the sheet stack (for example, the document stack P). The size specifying unit specifies a size in the sheet width direction of the sheet stack on the stacker based on an acquisition result of the position sensor.

When stacking the sheet stack of small-size original documents on the stacker, the user typically performs an operation of adjusting the position of the aligner to an approximate width of the sheet stack (i.e., the rough adjustment operation) prior to the operation to stack the sheet stack on the stacker (i.e., the sheet stacking operation). Since the position sensor acquires the position of the aligner in the sheet width direction, the size in the sheet width direction of the sheet stack on the stacker can be specified prior to the start of the switching from the separation state to the contact state. In other words, in consideration of the above-described typical work contents of the user, as the size in the sheet width direction of the sheet stack corresponding to the position of the aligner in the sheet width direction during the period decreases, it is estimated (specified) that the size in the sheet width direction of the sheet stack on the stacker is smaller.

Third Aspect

In the third aspect of the present disclosure, according to the second aspect, the position sensor acquires the position of the aligner in the sheet width direction in a period from when the sheet stack is placed on the sheet stacker to when switching of the aligner from the separation state to the contact state is started.

According to this configuration, since the position sensor can acquire the position of the aligner in the sheet width direction during the period from when the sheet stack is placed on the sheet stacker to when the switching from the separation state to the contact state is started, the size in the sheet width direction of the sheet stack on the stacker can be specified prior to the start of the switching from the separation state to the contact state.

Fourth Aspect

In the fourth aspect of the present disclosure, a sheet feeder (for example, the original document setter A) includes a stacker (for example, the document table 120), a sheet feeding member (for example, the pickup roller 141), an aligner (for example, the side fences 122), a switcher (for example, the base plate lifting motor 105), a size specifying unit (for example, the operation panel 5), a position sensor (for example, the side fence width sensors 116*a*, 116*b*, 116*c*, and 116*d*), and circuitry (for example, the controller 150). The stacker stacks a sheet stack (for example, the document stack P). The sheet feeding member contacts the sheet stack on the stacker to feed each sheet of the sheet stack. The aligner is movable in a sheet width direction of the sheet stack and aligns a position in the sheet width direction of the sheet stack on the stacker. The switcher switches the aligner from a separation state to a contact state without waiting for a feeding start instruction after the sheet stack is stacked on the stacker. The sheet stack on the stacker and the sheet feeding member separate from each other in the separation state. The sheet stack on the stacker and the sheet feeding member contact with each other in the contact state. The size specifying unit specifies a size in the sheet width direction of the sheet stack on the stacker. The position sensor acquires the position of the aligner in the sheet width direction. The circuitry delays a switching completion time from the separation state to the contact state when an error between a position of the aligner in the sheet width direction of the sheet stack corresponding to the size in the sheet width direction of the sheet stack specified by the size specifying unit and a position of the aligner in the sheet width direction of the sheet stack acquired by the position sensor is greater than a given error, to be later than the switching completion time when the error is equal to or smaller than the given error.

As the position of the aligner in the sheet width direction is displaced more greatly from the size in the sheet width direction of the sheet stack on the stacker, the aligner needs to be moved more greatly to move the aligner to the sheet stack for positioning, and the positioning operation of the aligner tends to take a longer time.

In this aspect, the circuitry delays the switching completion time from the separation state to the contact state when the error between the position of the aligner in the sheet width direction position corresponding to the size in the sheet width direction of the sheet stack specified by the size specifying unit and the position of the aligner in the sheet width direction position acquired by the position sensor is greater than the given error, to be later than the switching completion time when the error between the position of the aligner in the sheet width direction position corresponding to the size in the sheet width direction of the sheet stack specified by the size specifying unit and the position of the aligner in the sheet width direction position acquired by the position sensor is equal to or smaller than the given error According to this configuration, the sheet feeder can prevent occurrence of an inconvenience in which the user cannot complete the positioning operation of the aligner before the stacker is brought into the contact state when the position of the aligner in the sheet width direction is greatly displaced from the size in the sheet width direction of the sheet stack on the stacker.

Fifth Aspect

In the fifth aspect of the present disclosure, according to any one of the first to fourth aspects, the sheet feeder (for example, the original document setter A of the ADF 100) further includes an information receiver (for example, the operation panel 5) to receive size specifying information to specify the size in the sheet width direction of the sheet stack on the stacker. The size specifying unit (for example, the operation panel 5) specifies the size in the sheet width direction of the sheet stack on the stacker based on the size specifying information received by the information receiver.

According to this configuration, since the information receiver that is already included in the sheet feeder can be used to specify the size in the sheet width direction of the sheet stack on the stacker, no size specifying unit (for example, a sensor unit) is required separately, which can simplify the configuration.

Sixth Aspect

In the sixth aspect of the present disclosure, according to any one of the first to fifth aspects, the circuitry continuously change the switching completion time within a given range of the size in the sheet width direction of the sheet stack.

According to this configuration, the control to delay the switching completion time can be achieved in more detail.

Seventh Aspect

In the seventh aspect of the present disclosure, according to any one of the first to fifth aspects, the circuitry changes the switching completion time in phases within a given range of the size in the sheet width direction of the sheet stack.

According to this configuration, the control to delay the switching completion time can be achieved more easily.

Eighth Aspect

In the eighth aspect of the present disclosure, according to any one of the first to seventh aspects, the circuitry changes a switching start timing from the separation state to the contact state to change the switching completion time.

According to this configuration, the switching completion time can be delayed even when the switching speed from the separation state to the contact state is fixed.

Ninth Aspect

In the ninth aspect of the present disclosure, according to any one of the first to eighth aspects, the circuitry changes a switching speed of the switcher from the separation state to the contact state to change the switching completion time.

According to this configuration, the switching completion time can be delayed even when the switching start timing from the separation state to the contact state is fixed.

Tenth Aspect

In the tenth aspect of the present disclosure, according to any one of the first to ninth aspects, the sheet feeder (for example, the original document setter A of the ADF 100) further includes a sensor (for example, the document set sensor 115) disposed on the stacker. The sensor detects that the sheet stack is stacked on the stacker. The size specifying unit specifies the size in the sheet width direction of the sheet stack on the stacker at a detection of the sheet stack with the sensor.

According to this configuration, the size in the sheet width direction of the sheet stack on the stacker can be specified at an early stage.

Eleventh Aspect

In the eleventh aspect of the present disclosure, according to any one of the first to tenth aspects, the sheet feeding member contacts an uppermost sheet of the sheet stack on the stacker to feed the uppermost sheet.

According to this configuration, the sheet feeder in which the uppermost sheet of the sheet stack on the stacker is fed can prevent occurrence of an inconvenience in which the user cannot complete the positioning operation of the aligner to adjust the aligner to the width of the sheet stack (i.e., the positioning operation of the aligner) before the sheet stack on the stacker and the sheet feeding member contact with each other.

Twelfth Aspect

In the twelfth aspect of the present disclosure, an automatic sheet feeder (for example, the ADF 100) includes the sheet feeder (for example, the original document setter A) according to any one of the first to eleventh aspects.

According to this configuration, the automatic sheet feeder can prevent occurrence of an inconvenience in which the user cannot complete the positioning operation of the aligner to adjust the aligner to the width of the sheet stack (i.e., the positioning operation of the aligner) before the sheet stack on the stacker and the sheet feeding member contact with each other.

Thirteenth Aspect

In the thirteenth aspect of the present disclosure, an image reader (for example, the ADF 100) includes the sheet feeder (for example, the original document setter A) according to any one of the first to eleventh aspects.

According to this configuration, the image reader can prevent occurrence of an inconvenience in which the user cannot complete the positioning operation of the aligner to adjust the aligner to the width of the sheet stack (i.e., the positioning operation of the aligner) before the sheet stack on the stacker and the sheet feeding member contact with each other.

Fourteenth Aspect

In the fourteenth aspect of the present disclosure, an image forming apparatus (for example, the copier 1) includes the sheet feeder (for example, the original document setter A) according to any one of the first to eleventh aspects.

According to this configuration, the image forming apparatus can prevent occurrence of an inconvenience in which the user cannot complete the positioning operation of the aligner to adjust the aligner to the width of the sheet stack (i.e., the positioning operation of the aligner) before the sheet stack on the stacker and the sheet feeding member contact with each other.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet feeder comprising:

a stacker configured to stack a sheet stack;

a sheet feeding member configured to contact the sheet stack stacked on the stacker to feed each sheet of the sheet stack;

an aligner movable in a sheet width direction of the sheet stack and configured to align a position in the sheet width direction of the sheet stack on the stacker;

a switcher configured to switch the aligner from a separation state to a contact state without waiting for a feeding start instruction after the sheet stack is stacked on the stacker, the sheet stack on the stacker and the sheet feeding member separating from each other in the separation state, the sheet stack on the stacker and the sheet feeding member contacting with each other in the contact state;

a size specifying unit configured to specify a size in the sheet width direction of the sheet stack on the stacker; and circuitry configured to delay a switching completion time from the separation state to the contact state when the size in the sheet width direction of the sheet stack specified by the size specifying unit is smaller than a given size, to be later than a switching completion time when the size in the sheet width direction of the sheet stack is equal to or greater than the given size.

2. The sheet feeder according to claim 1, further comprising a position sensor disposed on the stacker and configured to acquire a position of the aligner in the sheet width direction of the sheet stack, wherein the size specifying unit is configured to specify a size in the sheet width direction of the sheet stack on the stacker based on an acquisition result of the position sensor.

3. The sheet feeder according to claim 2, wherein the position sensor is configured to acquire the position of the aligner in the sheet width direction in a period from when the sheet stack is stacked on the stacker to when switching of the aligner from the separation state to the contact state is started.

4. The sheet feeder according to claim 1, further comprising an information receiver configured to receive size specifying information to specify the size in the sheet width direction of the sheet stack on the stacker, wherein the size specifying unit is configured to specify the size in the sheet width direction of the sheet stack on the stacker based on the size specifying information received by the information receiver.

5. The sheet feeder according to claim 1, wherein the circuitry is configured to change the switching completion time continuously or in phases within a given range of the size in the sheet width direction of the sheet stack.

6. The sheet feeder according to claim 1, wherein the circuitry is configured to change a switching start timing or a switching speed of the switcher from the separation state to the contact state to change the switching completion time.

7. The sheet feeder according to claim 1, further comprising a sensor disposed on the stacker and configured to detect that the sheet stack is stacked on the stacker, wherein the size specifying unit is configured to specify the size in the sheet width direction of the sheet stack on the stacker at a detection of the sheet stack with the sensor.

8. The sheet feeder according to claim 1, wherein the sheet feeding member is configured to contact an uppermost sheet of the sheet stack on the stacker to feed the uppermost sheet.

9. An automatic sheet feeder comprising the sheet feeder according to claim 1.

10. An image reader comprising the sheet feeder according to claim 1.

11. An image forming apparatus comprising the sheet feeder according to claim 1.

12. A sheet feeder comprising:

a stacker configured to stack a sheet stack;

a sheet feeding member configured to contact the sheet stack on the stacker to feed each sheet of the sheet stack;

an aligner movable in a sheet width direction of the sheet stack and configured to align a position in the sheet width direction of the sheet stack on the stacker;

a switcher configured to switch the aligner from a separation state to a contact state without waiting for a feeding start instruction after the sheet stack is stacked on the stacker, the sheet stack on the stacker and the sheet feeding member separating from each other in the separation state, the sheet stack on the stacker and the sheet feeding member contacting with each other in the contact state;

a size specifying unit configured to specify a size in the sheet width direction of the sheet stack on the stacker;

a position sensor configured to acquire the position of the aligner in the sheet width direction; and circuitry configured to delay a switching completion time from the separation state to the contact state when an error between a position of the aligner in the sheet width direction of the sheet stack corresponding to the size in the sheet width direction of the sheet stack specified by the size specifying unit and a position of the aligner in the sheet width direction of the sheet stack acquired by the position sensor is greater than a given error, to be later than the switching completion time when the error is equal to or smaller than the given error.

13. The sheet feeder according to claim 12, further comprising an information receiver configured to receive size specifying information to specify the size in the sheet width direction of the sheet stack on the stacker, wherein the size specifying unit is configured to specify the size in the sheet width direction of the sheet stack on the stacker based on the size specifying information received by the information receiver.

14. The sheet feeder according to claim 12, wherein the circuitry is configured to change the switching completion time continuously or in phases within a given range of the size in the sheet width direction of the sheet stack.

15. The sheet feeder according to claim 12, wherein the circuitry is configured to change a switching start timing or a switching speed of the switcher from the separation state to the contact state to change the switching completion time.

16. The sheet feeder according to claim 12, further comprising a sensor disposed on the stacker and configured to detect that the sheet stack is stacked on the stacker, wherein the size specifying unit is configured to specify the size in the sheet width direction of the sheet stack on the stacker at a detection of the sheet stack with the sensor.

17. The sheet feeder according to claim 12, wherein the sheet feeding member is configured to contact an uppermost sheet of the sheet stack on the stacker to feed the uppermost sheet.

18. An automatic sheet feeder comprising the sheet feeder according to claim 12.

19. An image reader comprising the sheet feeder according to claim 12.

20. An image forming apparatus comprising the sheet feeder according to claim 12.

* * * * *